United States Patent [19]

Buchmüller

[11] Patent Number: 4,778,363

[45] Date of Patent: Oct. 18, 1988

[54] INTERNAL-GEAR MACHINE HAVING SEGMENTED, PIVOTAL FILLER MEMBERS

[75] Inventor: Klaus D. Buchmüller, Malsch, Fed. Rep. of Germany

[73] Assignee: Otto Eckerle GmbH & Co. KG, Fed. Rep. of Germany

[21] Appl. No.: 943,388

[22] Filed: Dec. 17, 1986

[30] Foreign Application Priority Data

Dec. 18, 1985 [DE] Fed. Rep. of Germany ..... 3544857

[51] Int. Cl.[4] ..... F03C 2/08; F04C 2/10; F04C 15/00

[52] U.S. Cl. ..... 418/126; 418/170

[58] Field of Search ..... 418/126, 169, 170

[56] References Cited

U.S. PATENT DOCUMENTS

| | | | |
|---|---|---|---|
| 2,482,713 | 9/1949 | Jones | 418/126 |
| 4,132,514 | 1/1979 | Eckerle | 418/126 |
| 4,472,123 | 9/1984 | Eckerle et al. | 418/126 |

*Primary Examiner*—John J. Vrablik
*Assistant Examiner*—Leonard P. Walnoha

[57] ABSTRACT

An internal-gear machine such as pump comprises a casing with an internally toothed annular gear rotatably mounted therein. An externally toothed pinion meshes with the internal teeth of the annular gear, and a generally sickle-shaped filling member which is split approximately in a circumferential direction is disposed in the clearance between the pinion and the annular gear. The end faces of the filling member portions which are towards the intake side of the machine may be of a convexly curved configuration and bear against a support element fixedly connected only to one wall of the casing so as to be radially slidable thereagainst and also pivotable about a pivot axis parallel to the axis of the pinion. Alternatively the end faces of the filling member portions may be flat and bear radially slidably against an intermediate element pivotally supported on an at least part-cylindrical peg fixed to only one wall of the casing.

5 Claims, 3 Drawing Sheets

INTERNAL-GEAR MACHINE HAVING SEGMENTED, PIVOTAL FILLER MEMBERS

BACKGROUND OF THE INVENTION

The invention relates generally to an internal-gear machine such as an internal-gear pump.

Generally, in an internal-gear machine of that kind, such as a pump, an externally toothed pinion or pump impeller is mounted eccentrically with respect to the body of the pump to actuate an internally toothed annular gear which rotates in the casing of the pump. Flow through the pump is practically continuous and without reversals and high rotary speeds may be used. To obtain the desired function, a filler member is disposed in the clearance between the internally and externally toothed gears. Thus, German laid-open application (DE-OS) No. 29 42 417 discloses an internal-gear machine which comprises a casing with an internally toothed annular gear mounted rotatably therein. An externally toothed pinion meshes with the teeth of the annular gear and a generally sickle-shaped filling member is disposed in the clearance between the gears. The filling member is divided along a generally circumferentially extending surface into first and second portions, the end faces of which bear against a support surface provided by a support pin member extending axially through the clearance between the gears. That arrangement provides that the filling member portions are displaceable in a radial direction against the support surface of the support pin member and can also perform a pivotal movement about the longitudinal axis thereof, by virtue of the support pin member being mounted rotatably. That provides that the portions of the filling member can be in substantially sealing relationship against the tips of the associated gears, even in the event of relative movements, wear and the like occurring. However, the rotatable mounting of the support pin member must be of a high degree of precision in order to attain the desired purpose; if that were not the case, the support pin member and/or the filling member bearing thereagainst would not be properly guided in the casing of the pump and could not perform the necessary movements to compensate for wear and the like. Furthermore, the support pin member, in order to provide a satisfactory support and guidance effect, must be mounted at both ends with a high degree of precision and that in turn means that the walls of the casing in which the support pin member is carried, that is to say, first and second casing portions which are disposed in opposite relationship in the assembled condition to define the space within which the internally toothed annular gear rotates, must be aligned relative to each other with a very high degree of accuracy and joined together in that aligned relationship. If the casing portions are not properly aligned, then the support member will be unable to perform a satisfactory pivotal movement to enable the filling member to perform its function. Such precision in turn requires a substantial level of expenditure in regard to manufacture and assembly, and that in turn results in the overall price of the machine being increased.

SUMMARY OF THE INVENTION

An object of the present invention is to provide an internal gear machine such as a pump which is of such a design as not to involve very extensive high-precision working operations in manufacture thereof.

Another object of the present invention is to provide an internal-gear machine which can be produced at lower cost than prior-art machines without suffering from a reduction in the quality of operation of the machine.

Still another object of the present invention is to provide an internal-gear pump which is of such a construction as to facilitate assembly thereof, by virtue of eliminating at least some high-precision fitting operations to be performed in the course of assembly.

In accordance with the principles of the present invention, in a first aspect, these and other objects are achieved by an internal-gear machine such as an internal-gear pump comrprising a casing having a cavity therein in which an internally toothed annular gear is mounted rotatably by means of the outside peripheral surface of the gear. Disposed within the annular gear is an externally toothed pinion which meshes with the teeth of the annular gear. Disposed in the clearance between the gear and the pinion is a generally sickle-shaped filling member which is divided along a substantially circumferentially extending surface providing first and second portions whose end faces which are towards the intake side of the casing bear against a support surface of a support element extending axially through the clearance between the gear and the pinion. The support element is connected fixedly only to one wall of the casing, while the end faces of the filling member portions bearing thereagainst have a convex curvature with the axis thereof extending parallel to the axis of rotation of the pinion. The filling member portions are thus displaceable in a generally radial direction against the support surface of the support element and are pivotable about a pivot axis which also extends parallel to the axis of rotation of the pinion.

In a second aspect of the invention, an internal-gear machine such as a pump comprises a casing providing a chamber therein in which an internally toothed annular gear is mounted rotatably by means of the outside peripheral surface of the gear. An externally toothed pinion meshes with the teeth of the annular gear and a generally sickle-shaped filling member is disposed in the clearance between the pinion and the gear. The filling member is divided along a substantially circumferentially extending line into first and second portions whose end faces which are towards the intake side of the casing bear against a support surface provided by a support assembly disposed in the above-mentioned clearance. The support assembly is formed by a peg or pin which is fixedly connected to only one wall of the casing and which has an at least part-cylindrical bearing surface, and an intermediate member which is interposed between the filling member portions and the peg or pin and provides the above-mentioned support surface for the filling member portions. The intermediate member between the peg or pin and the filling member portions has a sliding surface which is a complementary curvature to the bearing surface of the peg or pin. The filling member portions are thus displaceable in a radial direction against the support surface provided by the intermediate member and are also pivotable about the axis of the peg or pin, being parallel to the axis of rotation of the pinion.

It will be seen that unlike the prior-art machine discussed above, the invention in its first and second aspects has the common feature that instead of a rotatably mounted peg or pin which is supported at both ends in the walls of the casing to provide for the pivotal movement of the filling member, the invention provides a support element which is connected fixedly and thus non-rotably to just one wall of the casing. By virtue of the fact that the support element is fixedly mounted at one end and more specifially in an advantageous embodiment can be provided by the support element being formed in one piece with the wall of the casing, clearances and play which could occur due to bearing and mounting tolerances in mounting the rotatably mounted peg or pin of the prior-art machine are eliminated and in addition the degree of elastic deformation can also be minimised. In order to provide for the desired pivotal movement of the filling member portions, in spite of the fact that the support element against which they bear is not mounted rotatably to the casing, the filling member portions bear against the support surface of the support element of the first aspect of the invention by means of convexly curved end faces so that they are displaceable thereagainst in at least substantially radial direction while in addition they are capable of performing rolling movements by virtue of the curved configuration of the end faces thereof. Such rolling movements about the axis of the curvature of the end faces of the filling member portions provide for the necessary pivotal movement of the filling member portions about that axis and thus permit the filling member portions to bear individually against the tips of the respective teeth of the internally toothed annular gear and the externally toothed pinion. In the second aspect of the invention the filling member portions bear against the intermediate member which has the support surface at one side thereof while on the other side it has a sliding or bearing surface co-operating with the fixed mounting peg or pin at the at least part-cylindrical mounting surface thereof. That construction provides that the radial movements of the filling member portions which are required to compensate for radial clearances or gaps occur by the end faces of the filling member portions sliding against the support surface of the intermediate member while the pivotal movements of the filling member portions are produced by the intermediate member pivoting about the bearing surface provided by the fixed peg or pin.

As will be readily appreciated, as in both the above-defined aspects of the invention the support assembly for the filling member is connected only to one wall of the casing and is thus independent of the position of the other wall of the casing relative thereto, there is now no need for precise alignment of the two walls of the casing relative to each other, just in order to provide for suitable mounting of the support element. That is generally the case even if the externally toothed pinion is mounted in the casing at both sides thereof, as the means for mounting the pinion do not require the same level of precision as the means for mounting the rotatable support pin in the prior-art machine which has to be supported at both ends thereof. However there is even less need for a particular degree of accuracy in regard to alignment of the co-operating portions of the casing if, instead of being mounted in the casing at both sides, the externally toothed pinion is also mounted in the casing only at one side thereof, being therefore supported in the chamber in the casing in what is referred to as overhung relationship, or alternatively the pinion may be supported by a mounting means at one side of the casing on the outside thereof instead of being actually supported in the wall of the casing at one side, so that in that way, when the co-operating portions of the casing are brought together, there is also no need to take account of the positioning of the pinion mounting assembly. In both cases, the casing wall which is without mounting elements for either the support member or the externally toothed pinion only needs to bear sealingly against the end faces of the support element and the pinion, to minimise leakage between those components and the wall of the casing.

The support surface against which the convexly curved end faces of the filling member portions bear in the above-defined first aspect of the invention is advantageously at least substantially flat in order not to impede radial displaceability of the filling member portions. It is also possible however to consider using a surface which has a slight degree of concave curvature insofar as that does not result in substantial displacement of the filling member portions in the peripheral direction of the chamber in the casing, upon radial displacement of the filling member portions relative to the support, because that reduces the loading at the contact location between the filling member portions and the support surface.

In an advantageous feature of the invention in its second aspect as defined above, the peg or pin which provides the support effect for the intermediate element is a cylindrical peg or pin which is pressed into a bore in the wall of the casing and which is partially embraced by the co-operating bearing surface of the intermediate portion, which is of a corresponding partly hollow-cylindrical configuration. The support surface of the intermediate member may also be reduced or partly cut back because in the construction in accordance with the second aspect of the invention that surface is subjected to a lower level of loading.

Further objects, features and advantages of the present invention will become apparent from the following description of preferred embodiments thereof.

DESCRIPTION OF THE PREFERRED EMBODIMENTS

Figure 1:
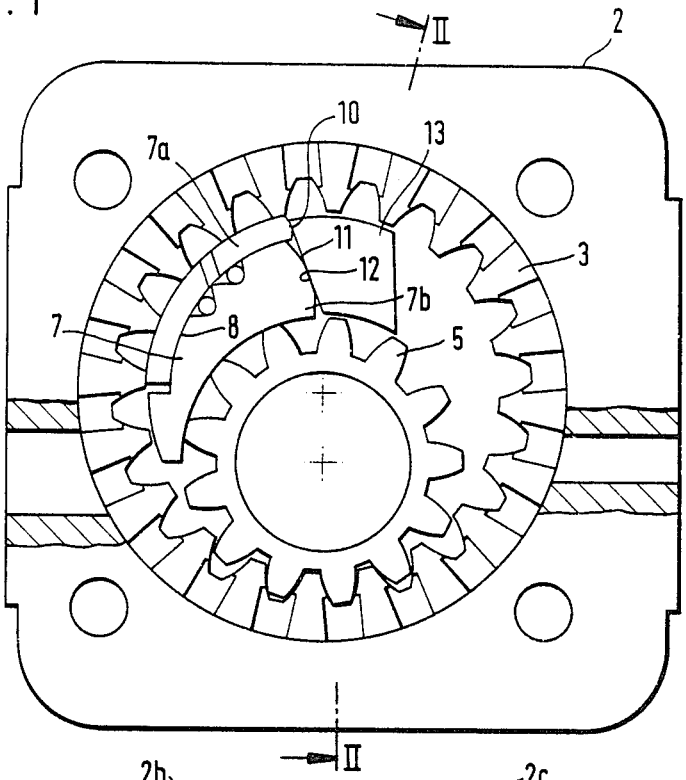
FIG. 1 is a side view of the machine according to the invention, viewing into the open casing of an embodiment in accordance with the first aspect of the invention.
Figure 2:
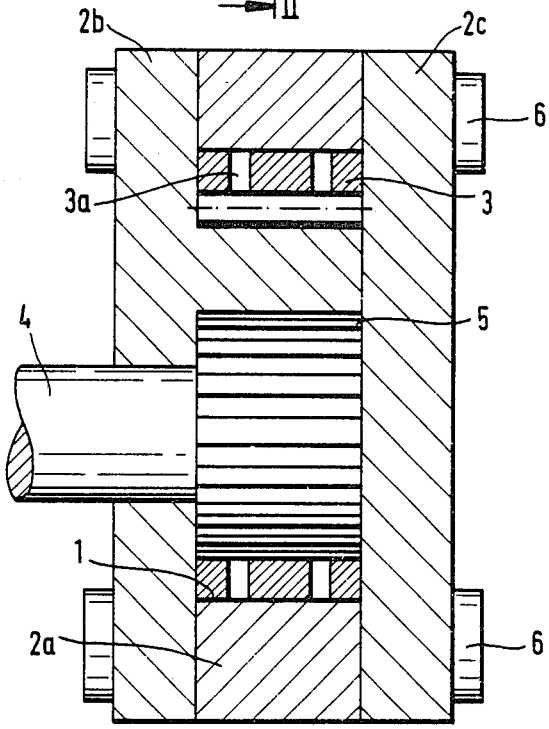
FIG. 2 is a view in section taken along line II—II in FIG. 1.

Referring firstly to FIGS. 1 and 2, illustrated therein is an internal-gear machine in the form of an internal-gear pump in accordance with the teaching of the first aspect of this invention.

The pump shown in FIGS. 1 and 2 comprises a casing 2 which has a bore 1 therein, providing a chamber for accommodating the gear and pinion of the pump, to which further reference will be made hereinafter. An internally toothed hollow gear 3 is mounted in the bore 1 in the casing 2, by virtue of the outside peripheral surface of the gear 3 co-operating with a corresponding bearing surface provided by the casing 2. The casing 2 comprises three major portions, namely a central annular portion 2*a*, a plate portion 2*b* which is connected to the annular portion 2*a* at the left-hand side thereof in FIG. 2, and a second plate portion 2*c* which is connected to the annular portion 2*a* in opposite relationship to the first plate portion 2*b*. The portions 2*a*, 2*b* and 2*c* of the casing are connected together and sealingly braced against each other by means of screws or bolts 6.

The plate portion 2*b* of the casing has an axial bore through which extends a shaft 4 carrying an externally toothed pinion 5. The teeth on the pinion 5 mesh with the teeth on the annular gear 3, as can be clearly seen from FIG. 1. The pinion 5 is thus supported at one side thereof by means of the shaft 4 so that the pinion is disposed in overhung relationship in the chamber defined in the casing 2 by the bore 1 thereof. The end face of the pinion 5 which is towards the right in FIG. 2 bears sealingly against the inside surface of the plate portion 2*c* of the casing.

The shaft 4 supporting the pinion 5 may be mounted by suitable means (not shown) in the bore in the plate portion 2*b*, or alternatively it may be mounted by support means disposed outside the casing, in which case the bore in the plate portion 2*b* through which the shaft 4 extends only has a suitable sealing means for providing a seal between the shaft 4 and the casing plate portion 2*b*.

Referring still to FIG. 1, it will be seen that a generally sickle-shaped clearance is provided between the gear 3 and the pinion 5. Arranged in that clearance is a filling member which is generally identified by reference numeral 7 in FIG. 1 and which is made up of two filling member portions 7*a* and 7*b*. More specifically, the filling member 7 is divided along a substantially circumferentially extending surface as indicated at 8, at which therefore the filling member portions 7*a* and 7*b* bear against each other. At their end faces which face towards the intake side of the pump, such faces being indicated at 10 and 11, the filling member portions 7*a* and 7*b* bear against an at least substantially flat surface 12 provided by a support element 13. It will be seen from FIG. 2 that the support element 13 which is thus interposed between the annular gear 3 and the pinion 5 extends through the above-mentioned sickle-shaped clearance in which the filling member 7 is arranged, in the axial direction of the pump casing, in parallel relationship for example to the axis of rotation of the shaft 4 and the pinion 5. It will be clearly seen from FIG. 2 that in this embodiment the support element 13 is in one piece with the plate portion 2*b*. It will be seen further from FIG. 1 that the sides of the support element 13 which are disposed adjacent the tips of the teeth of the annular gear 3 and the tips of the teeth on the pinion 5 respectively are disposed closely adjacent thereto and are of a configuration such as to substantially conform therewith.

The end faces 10 and 11 of the filling member portions 7*a* and 7*b* are of a part-cylindrical convex curvature, with the axis of the curvature extending parallel to the axes of the gear 3 and the pinion 5 and the longitudinal axis or longitudinal centre line of the support element 13.

The filling member portion 7*a*, as illustrated, is of a generally shell-like configuration, that is to say is of a curved configuration with the curved side walls thereof being at least generally equidistant from each other along the peripheral length of the portion 7*a*, and it further has a pressure compensating bore (not shown) which leads to a space defined in the filling member portion 7*b* in which two mutually parallel sealing rollers are mounted. The mode of operation of that arrangement is known and does not need to be described in greater detail herein.

As shown in FIG. 1 but not referenced and as shown in FIG. 2 at reference numeral 3*a*, the annular gear 3 has bores 3*a* which extend radially therethrough, from the bottom of the gaps between the teeth thereof. The bores 3*a* serve to carry the flow of fluid which is to pass through the chamber defined by the casing 2 of the pump, for the delivery and discharge ducts provided in the casing 2, which are shown but not referenced in FIG. 1.

Figure 4:
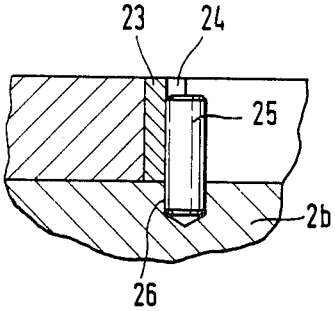
FIG. 4 is a view in section taken along line IV—IV in FIG. 3 of part of a detail thereof.
Figure 3:
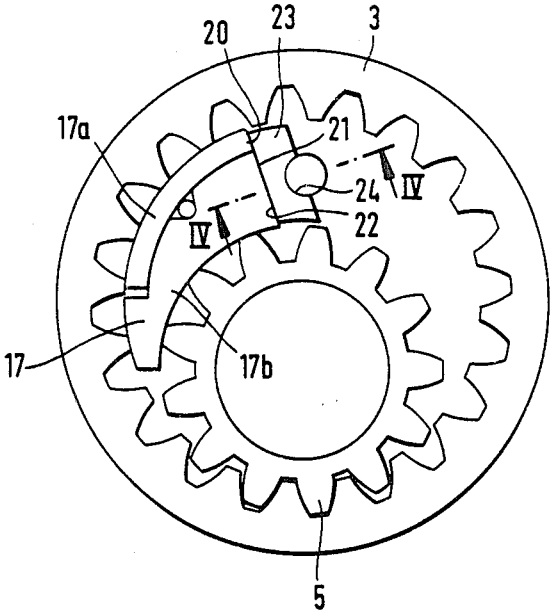
FIG. 3 is a side view of an embodiment in accordance with the second aspect of the invention without however illustrating the casing, for the sake of enhanced clarity and simplication of the drawing.

Reference will now be made to FIGS. 3 and 4, which is of generally the same construction as the embodiment shown in FIGS. 1 and 2, with the exception of the assembly consisting of the filling member and its support arrangement in the sickle-shaped clearance between the annular gear 3 and the rotary pinion 5. For that reason, FIGS. 3 and 4 do not show the casing of the pump, and components in FIGS. 3 and 4 which are the same as those shown in FIGS. 1 and 2 are denoted by the same references.

Referring now therefore more specifically to the assembly consisting of the filling member and its support arrangement, in this embodiment the filling member 17 comprises first and second filling member portions 17*a* and 17*b* which are defined by a circumferentially extending division in the filling member 17, in substantially the same manner as the filling member 7 shown in FIGS. 1 and 2. In this embodiment however the filling member portions 17*a* and 17*b* have at least substantially flat end faces 20 and 21 at their ends which are towards the intake side of the pump. The end faces 20 and 21 bear against a support surface 22 on an intermediate member 23. The support surface 22 is also at least substantially flat. The intermediate portion 23 is substantially in the configuration of a shallow parallelopiped and on its side which is in opposite relationship to the support surface 22 it has a groove forming a sliding bearing surface 24. The groove is of a part-cylindrical configuration, as can be clearly seen from FIG. 3, and extends in a direction parallel to the axes of rotation of the annular gear 3 and the pinion 5. The bearing surface 24 co-operates with a corresponding bearing surface of a peg or pin 25. The peg or pin 25 is substantially cylindrical and is pressed into a bore 26 in the inside surface of the plate portion 2*b* of the casing. While the peg or pin 25 is shown as being cylindrical, in a modified embodiment it is possible for the circumferential surface of the peg or pin to be part-cylindrical, thereby to provide the bearing surface co-operating with the bearing surface 24 in the intermediate member 23.

It will be seen that the peg or pin 25 is supported in the chamber defined in the casing 2, by being mounted in the plate portion 2*b* of the casing only at one end of the peg or pin.

Having described the structure of the pumps shown in FIGS. 1 and 2, and FIGS. 3 and 4 respectively, reference will now be made to the mode of operation thereof:

Thus, in operation of the embodiment shown in FIGS. 1 and 2, the filling member portions 7*a* and 7*b* bear by means of their convexly curved end faces 10 and 11 against the support surface 12 of the support element 13 and, under the pressure forces acting thereon, can perform compensating movements in an at least substantially radial direction by virtue of the end faces 10 and 11 sliding against the support surface 12. In addition, by virtue of the convex configuration of the end faces 10 and 11, the filling member portions *7a* and *7b* may also perform rolling movements against the support surface 12, which provide for pivotal motion of the filling member portions *7a* and *7b*. In that way, the filling member 7 can follow the relative movements of the components which occur during operation of the pump, and can prevent the formation of substantial radial gaps between components which should be in sealing contact with each other.

In the embodiment shown in FIGS. 3 and 4, the filling member portions 17*a* and 17*b* are displaceable in an at least substantially radial direction against the support surface 22 of the intermediate element 23. Furthermore, the filling member 17 can perform a pivotal movement by virtue of the intermediate element 23 being rotatably mounted on the peg or pin 25.

It will be appreciated that the above-described constructions have been set forth only by way of example of the principles of the present invention, and that other modifications and alterations may be made therein without thereby departing from the spirit and scope of the present invention. For example, there is no need for the curvature of the end faces 10 and 11 of the filling member portions *7a* and *7b* to be of a regular or cylindrical nature, as it is also possible to envisage using a convex curvature in which the radius of curvature is not constant, in order to provide for the necessary rolling and pivotal movements. A similar point applies in regard to the bearing surface of the peg or pin 25 and the surface 24 of the intermediate element 23, which slides thereon.

Figure 5:
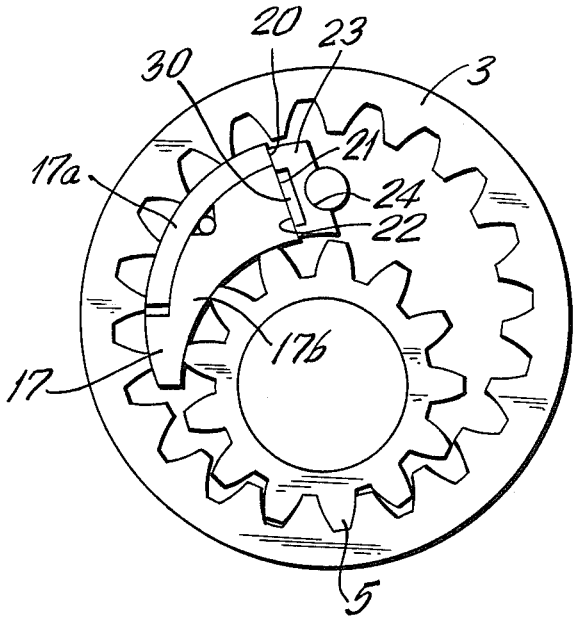
FIG. 5 is a side view similar to FIG. 3 showing an embodiment in accordance with a third aspect of the invention.

The machine set forth herein may be produced entirely from plastic material, in which respect forming the support element 13 or the peg or pin 25 in one piece with the associated wall portion of the casing presents itself as a ready possibility. Finally, the support surface 22 of the intermediate member 23 may be reduced in the form of a recess 30 therein as shown in FIG. 5.

I claim:

1. An internal-gear machine comprising: a casing; an internally toothed annular gear mounted rotatably in the casing; an externally toothed pinion rotatably disposed within the annular gear and meshing with a portion of the annular gear, a clearance being defined between said pinion and the remaining portion of the annular gear; a generally sickle-shaped filling member disposed in said clearance and divided along a substantially circumferentially extending surface, thereby providing first and second filling member portions having end faces at their ends towards the intake side of the casing; a support pin means disposed at a spacing from said end faces of said filling member portions and fixedly carried by only one wall of said casing and having an at least part-cylindrical bearing surface; and an intermediate member disposed between said end faces and said pin means and providing an at least substantially flat support surface against which said end faces bear slidably in an at least substantially radial direction, the surface of said intermediate member in opposite relationship to said support surface providing a bearing surface of complementary configuration to and co-operating with said bearing surface of said pin means, thereby to provide for pivotal movement of said filling member portions about an axis extending at least substantially parallel to the axis of rotation of said pinion.

2. A machine as set forth in claim 1 wherein said casing defines therein a chamber having a radially inwardly facing circular surface and wherein said annular gear has an external bearing surface co-operating with said circular surface for rotatably mounting said annular gear.

3. A machine as set forth in claim 1 wherein said pin means is a substantially cylindrical pin which is a pressed fit in a bore in said wall of the casing.

4. A machine as set forth in claim 1 wherein said support surface is partially reduced on said intermediate member.

5. A machine as set forth in claim 1 in the form of a pump.

* * * * *